US007959760B1

(12) United States Patent
Galbraith

(10) Patent No.: US 7,959,760 B1
(45) Date of Patent: Jun. 14, 2011

(54) AUTOMATED GLUED DOWN CARPET REMOVER IMPROVEMENTS

(76) Inventor: Leonard Galbraith, Vero Beach, FL (US)

( * ) Notice: Subject to any disclaimer, the term of this patent is extended or adjusted under 35 U.S.C. 154(b) by 0 days.

(21) Appl. No.: 13/021,440

(22) Filed: Feb. 4, 2011

Related U.S. Application Data

(63) Continuation-in-part of application No. 12/688,279, filed on Jan. 15, 2010.

(51) Int. Cl.
*B32B 38/10* (2006.01)

(52) U.S. Cl. ..... 156/714; 156/717; 156/764; 156/929; 156/940; 254/202; 254/213; 254/227; 294/103.1

(58) Field of Classification Search ..... 156/584, 156/344; 254/199, 200, 202, 203, 208, 209, 254/210, 211, 213, 219, 227, 242, 262; 294/8.6, 294/103.1, 104, 119.1, 902; 269/53, 54.5; 16/5

See application file for complete search history.

(56) References Cited

U.S. PATENT DOCUMENTS 4,332,371 A 6/1982 Bell
4,533,118 A 8/1985 Thomas
4,560,146 A 12/1985 Thomas
4,906,323 A 3/1990 Thomas
5,387,308 A 2/1995 Heavrin
5,454,899 A 10/1995 Glenn
5,456,794 A * 10/1995 Barrett ..... 156/584
5,720,844 A 2/1998 Hanson
5,909,868 A 6/1999 Galella
6,004,426 A 12/1999 Johnson
7,032,886 B1 4/2006 Kraft
7,097,157 B1 * 8/2006 Lodrick ..... 254/362

OTHER PUBLICATIONS

Floor Covering Removal, #71 Powered Carpet Puller TM. Taylor Tools, Taylor Tools Distributor, 2004, pp. 1-39, www.taylortools.com.

* cited by examiner

*Primary Examiner* — Mark A Osele
*Assistant Examiner* — Nickolas Harm
(74) *Attorney, Agent, or Firm* — Brian S. Steinberger; Law Offices of Brian S. Steinberger, P.A.

(57) ABSTRACT

Apparatus, devices, systems and methods for removing automatically removing fixed carpeting such as glued down carpeting from spaces. The apparatus can include a motor powered winch having a hook end that can grip about a raised edge of the carpet. The winch can be anchored to a doorway by clamping ends of a telescopic bar to doorjamb members about the doorway opening. An operator can operate the winch by remote control and be spaced outside the room that the carpet is being removed from. Another version can include a U-shaped telescopic clamp arrangement so that the winch is also spaced outside the room from which the carpet is being removed. Another version includes a carpet grabbing plate adapter having hooks on a top side and carpet grabbing teeth extending below. The clamp ends of the telescopic bar can be locked to the upper hooks on the carpet grabbing plate. Another version has a double jawed carpet grabber with a pair of handles and teeth with channel members for enhanced carpet edge grabbing. Another version has a carrying case with handles and wheel(s) so that the carpet removing device and associated components can be hand carried and/or rolled.

15 Claims, 20 Drawing Sheets

AUTOMATED GLUED DOWN CARPET REMOVER IMPROVEMENTS

This application is a Continuation-in-Part of application Ser. No. 12/688,279, filed on Jan. 15, 2010.

This invention relates to carpet removing, in particular to apparatus, devices, systems and methods for removing automatically removing fixed carpeting such as glued down and tacked down carpeting from rooms and other spaces.

BACKGROUND AND PRIOR ART

The removal of glued down carpeting has often typically required human laborers to physically peel up the carpeting with either their hands or some hand tools, such as pry bars, and screw drivers, etc. In addition, the laborer must then pull and rip the carpeting out which is very difficult since they often must stand on the actual carpeting they are removing. The hand tools used can often damage the underlying floor beneath the carpet which will require additional time and expense to fix. Often physical injuries such as wrenched backs, and torn up hands result from such removal techniques. In addition, this time consuming work will often takes hours if not days to accomplish for large amounts of spaces and buildings, which adds additional expense.

Devices have been attempted over the years to try to remove carpeting but still have problems of their own. See for example, U.S. Pat. No. 4,332,371 to Bell et al.; U.S. Pat. No. 4,533,118 to Thomas et al.; U.S. Pat. No. 4,560,146 to Thomas et al.; U.S. Pat. No. 4,906,323 to Thomas; U.S. Pat. No. 5,387,308 to Heavrin; U.S. Pat. No. 5,454,899 to Glenn et al.; U.S. Pat. No. 5,720,844 to Hanson; U.S. Pat. No. 5,909,868 to Galella; U.S. Pat. No. 6,004,426 to Johnson; U.S. Pat. No. 7,032,886 to Kraft.

Thomas '323, Heavrin '308, Hanson '844, and Gaiella '868 each require a laborer having to physically grip tools to remove the carpeting, which would be undesirable for being at least time consuming and labor intensive.

Bell '371, Thomas '118, Thomas '146, Kraft '886, and Johnson '426 have automated machines that generally require an operator be adjacent to the machine for operate, and the machine is placed directly on the carpet. Thus, the machines would generally need to be constantly moved about so that the carpet under the machines is removed. Also, some of these machines require anchoring through the carpeting which could be difficult to achieve and could potentially damage the sub floor under the carpeting. Additionally, many of these machines can require two or more persons to operate, and the machines can cost in the thousands of dollars, which makes them further undesirable to use.

Thus, the need exists for solutions to the above problems with the prior art.

SUMMARY OF THE INVENTION

A primary objective of the present invention is to provide apparatus, devices, systems and methods for automatically removing fixed carpeting such as glued down carpeting and tacked down carpeting from spaces that eliminates any labor extensive efforts of having to physically pull up and tear out the carpet.

A secondary objective of the present invention is to provide apparatus, devices, systems and methods for automatically removing fixed carpeting such as glued down carpeting and tacked down carpeting from spaces without having to physically move or drag tools or machines about the carpet.

A third objective of the present invention is to provide apparatus, devices, systems and methods for automatically removing fixed carpeting such as glued down carpeting and tacked down carpeting from spaces that allows for an operator to be spaced away from and not in the same room as the carpet that is being removed.

A fourth objective of the present invention is to provide apparatus, devices, systems and methods for automatically removing fixed carpeting such as glued down carpeting and tacked down carpeting from spaces that does not require anchoring through the floor.

A fifth objective of the present invention is to provide apparatus, devices, systems and methods for automatically removing fixed carpeting such as glued down carpeting and tacked down carpeting from spaces that substantially reduces the time and labor to remove the carpeting.

A sixth objective of the present invention is to provide apparatus, devices, systems and methods for automatically removing fixed carpeting such as glued down carpeting and tacked down carpeting from spaces so that only one person is needed to remove carpeting in a timely manner from any size room.

A seventh objective of the present invention is to provide apparatus, devices, systems and methods of automatically removing fixed down carpeting, such as glued down carpeting and tacked down carpeting, with an inexpensive machine that is light enough to be carried and transported by a single operator.

Improvements

An eighth objective of the present invention is to provide apparatus, devices, systems and methods of automatically removing fixed down carpeting, such as glued down carpeting and tacked down carpeting, with a double clamp locking jaw that provides enhanced gripping strength on a carpet edge.

A ninth objective of the present invention is to provide apparatus, devices, systems and methods of automatically removing fixed down carpeting, such as glued down carpeting and tacked down carpeting, with a carpet grabbing floor plate that allows for the winch and motor and telescoping bars with clamp ends to be floor mounted.

A tenth objective of the present invention is to provide apparatus, devices, systems and methods of automatically removing fixed down carpeting, such as glued down carpeting and tacked down carpeting, with a wheeled carrying case that allows the devices and systems to be both portable and readily able to be rolled into and out of a space for carpet removal.

A novel automated carpet removing device, can include a motor powered winch having an elongated line rolled thereon, the line having an outer end, a carpet gripper attached to the outer end of the line adapted for gripping a raised edge of a carpet, and a doorway anchor for mounting the winch adjacent to a doorway of a room that the carpet is to be removed.

The doorway anchor can include telescoping bars having a first outer end and a second outer end. The anchor can include a first clamp attached to the first outer end that clamps about a first vertical frame member of a doorjamb, and a second outer clamp attached to the second outer end that clamps about a second vertical frame member of the doorjamb.

The first clamp and the second clamp can each include a telescoping member for allowing the first clamp and the second clamp to expand or contract about different widths of the doorjamb.

The first clamp and the second clamp can each include an elongated telescoping member for allowing the first clamp and the second clamp to expand or contract about different widths of the doorjamb, and mount the winch outside the room in which the carpet is being removed.

A remote control for operating the winch can be included so that an operator is adapted to be located outside the room in which the carpet is being removed.

The carpet edge gripper can include a carpet edge clamp having gripping teeth for locking about the raised edge of the carpet.

The doorway anchor can include members for mounting the winch directly inside of the doorway. The doorway anchor can include members for mounting the winch to be located outside to the doorway and outside of the room in which the carpet is being removed.

A novel method of automatically removing carpeting from a room, can include the steps of mounting a motor powered winch to doorjambs of a doorway of a room where carpeting is to be removed, attaching an outer end of an elongated line wrapped about the winch to a raised edge of carpeting spaced away from the winch, and operating the winch to retract the elongated line in order to start removal of the carpeting from the room.

The mounting step can include the step of clamping ends of a bar about each doorjamb. The method can include the step of telescopingly expanding or retracting the bar so at fit within the doorway.

The clamping step can include the steps of clamping a first end of the bar with a first width adjustable clamp about a first doorjamb, and clamping a second end of the bar with a second width adjustable clamp about a second doorjamb.

The mounting step can include the step of mounting the winch directly inside of the doorway of the room where the carpet is to be removed. The mounting step can include the step of mounting the winch to be located outside to the doorway and outside of the room in which the carpet is being removed.

Additional embodiments of the invention can use a carpet grabbing plate adapter having raised upper hooks, and a lower surface having carpet grabbing teeth. The adapter allows for the doorway mounted automatic device to be floor mounted. The clamp ends of the automated device can be locked into the upper hooks on the carpet grabbing plate, which is then secured to the carpet by the downwardly protruding teeth.

Still another embodiment can use double clamp jaws for securing edges of the carpeting having easy to operate handles so that a carpet edge can be more securely locked. The double jaws can include channels in the top pivotable jaws that pass between the raised teeth in the base.

Still another embodiment allows for carrying case that can easily store and be used to transport the automatic carpet removing device with or without the carpet gripping adapter plate and double jaws. The case can have handles to allow the entire case to be lifted and carried. Alternatively, the case, can have a wheel or wheels at one end that allows the case to be wheeled about similar to luggage having wheels.

Further objects and advantages of this invention will be apparent from the following detailed description of the presently preferred embodiments which are illustrated schematically in the accompanying drawings.

Improvements

Double Clamp Lock Jaws

Figure 14:
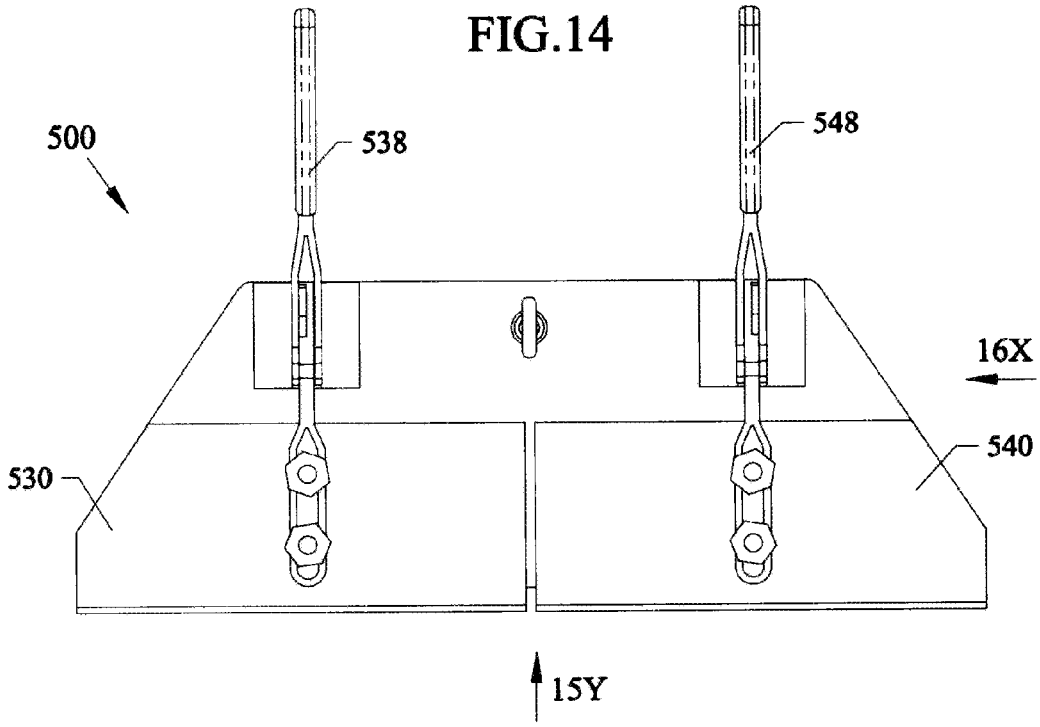

FIG. 14 is a top view of a novel double clamp lock jaws for a carpet edge in lock position.

Figure 15:
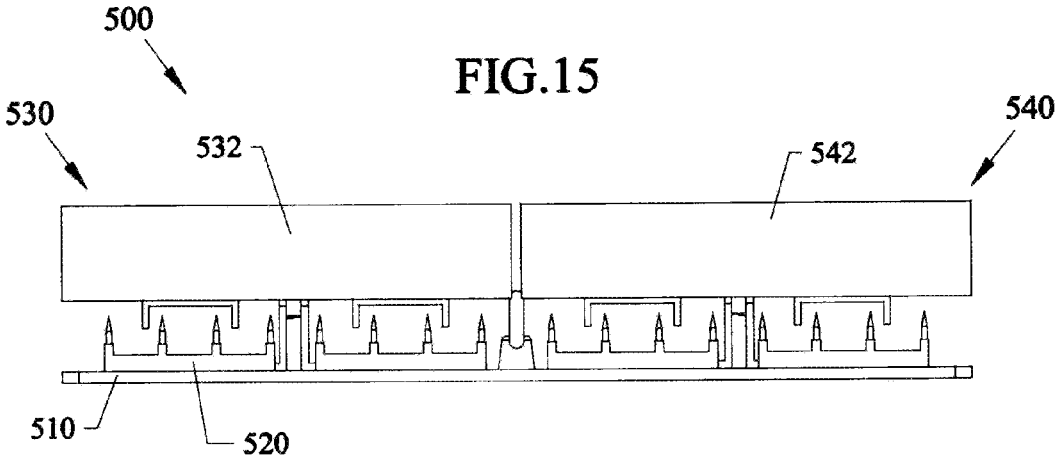

FIG. 15 is a front view of the double clamp lock jaws of FIG. 14 along arrow 15Y.

Figure 16:
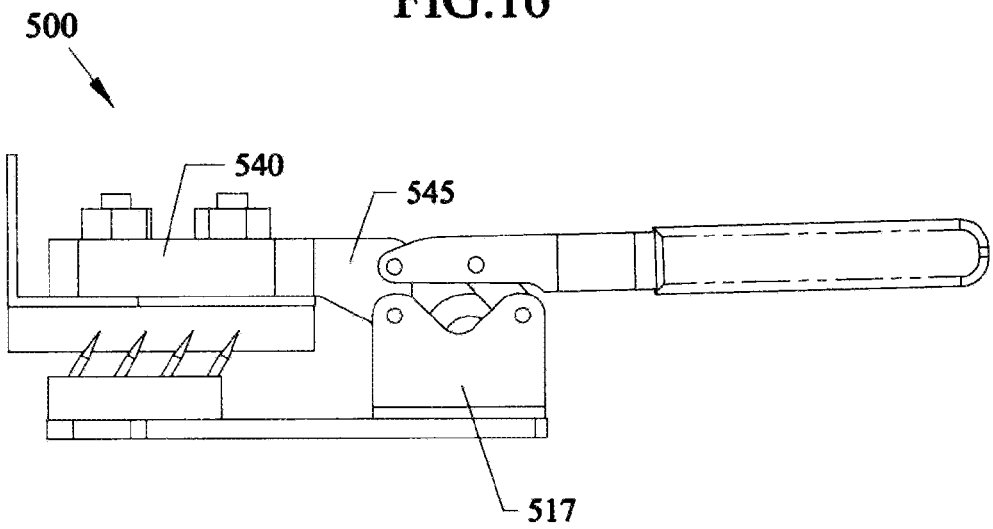

FIG. 16 is a right side view of the double clamp lock jaws of FIG. 14 along arrow 16X.

Figure 17:
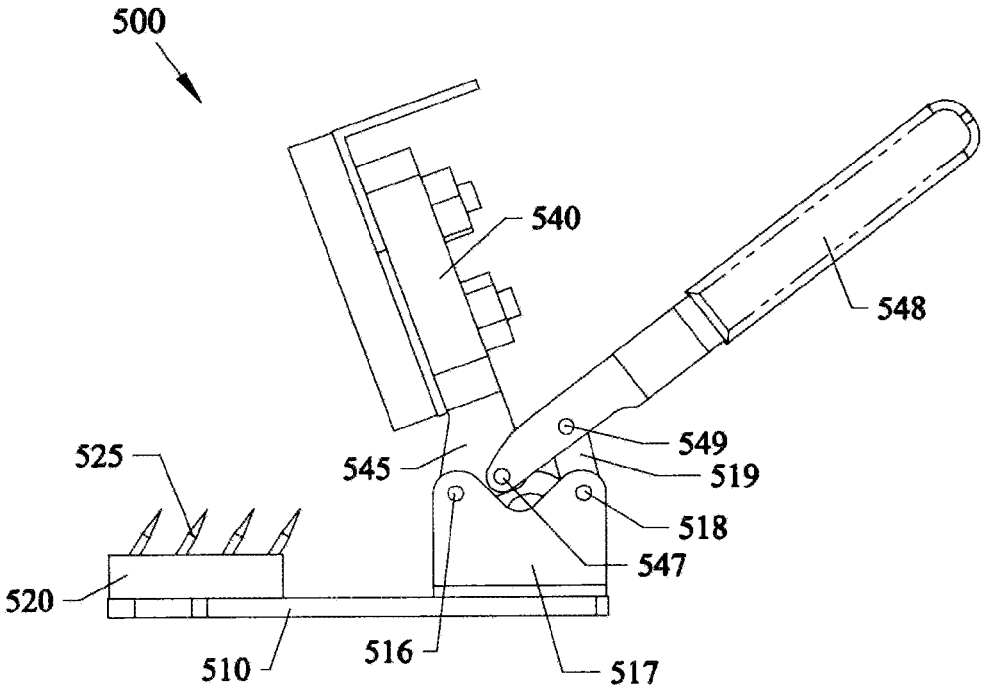

FIG. 17 is another right side view of the double clamp lock jaws of FIG. 16 with the upper jaws in an open position.

Figure 1:
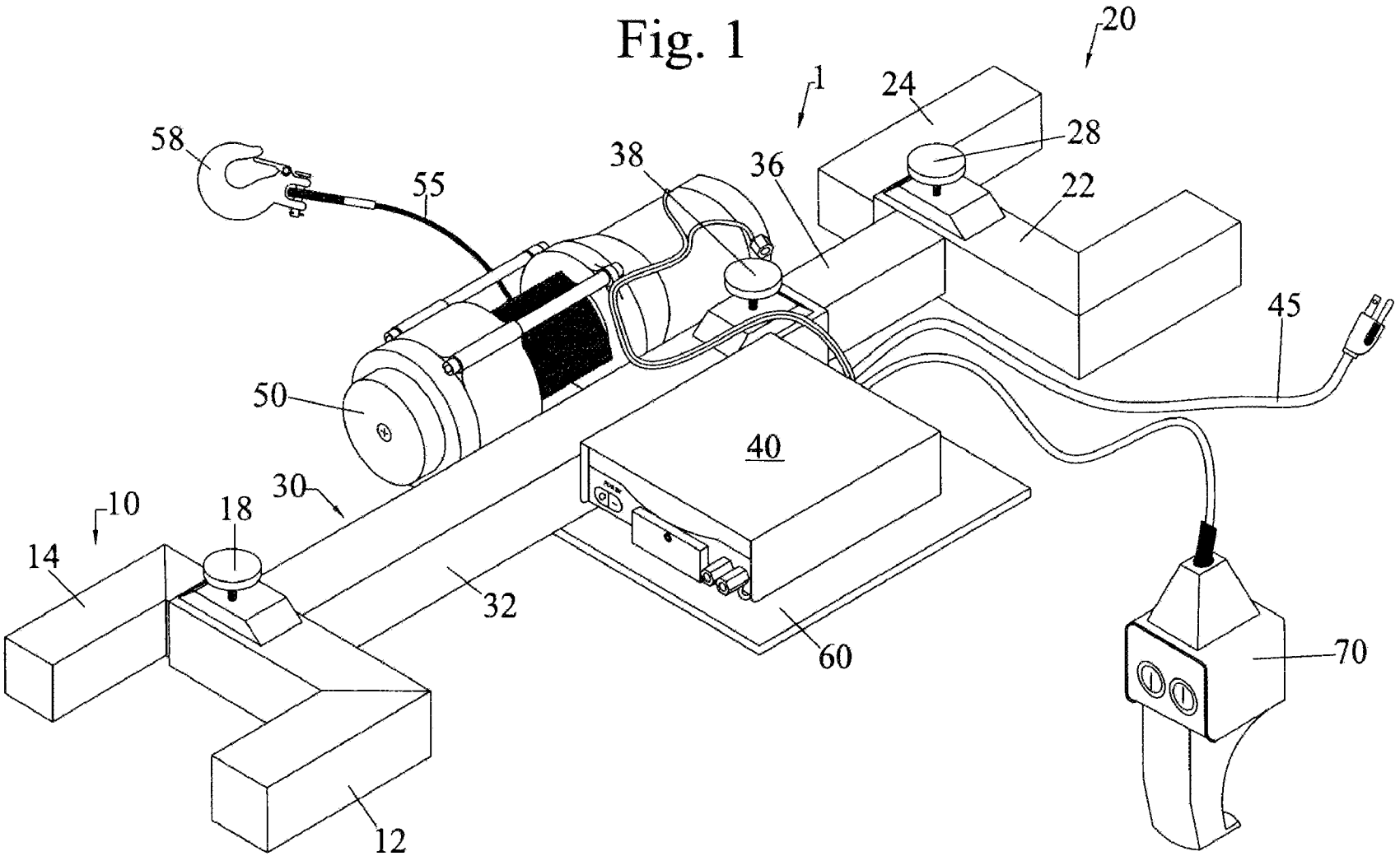
FIG. 1 is an upper perspective view of the novel carpet removing device.
Figure 18:
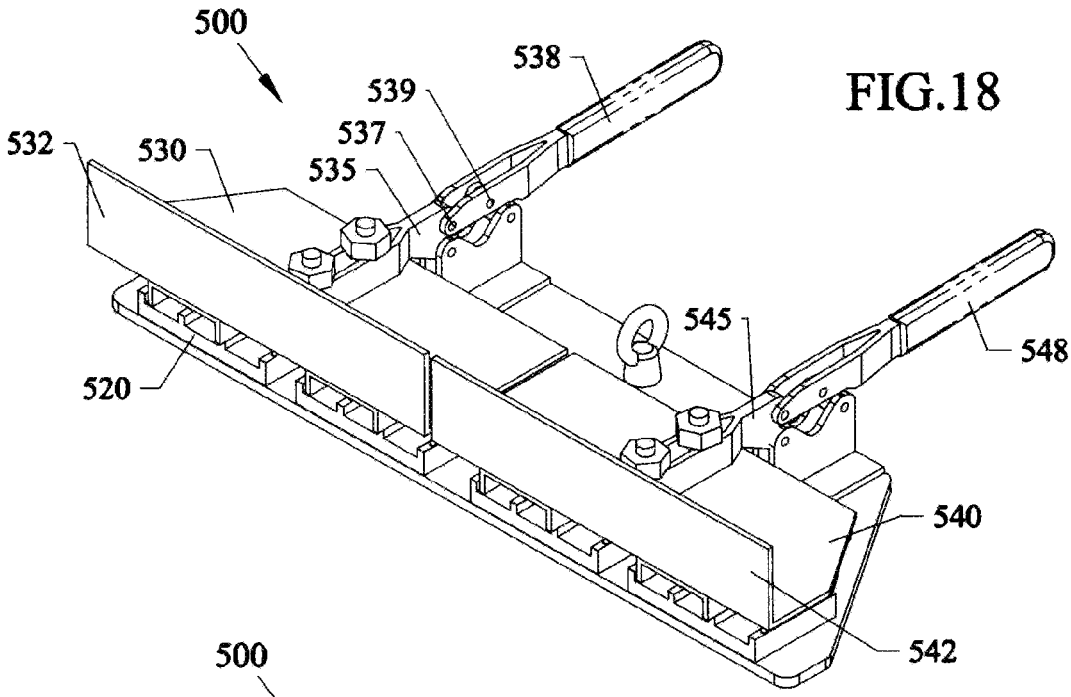

FIG. 18 is an upper front right perspective view of the double clamp lock jaws of FIG. 1 in a lock position.

Figure 19:
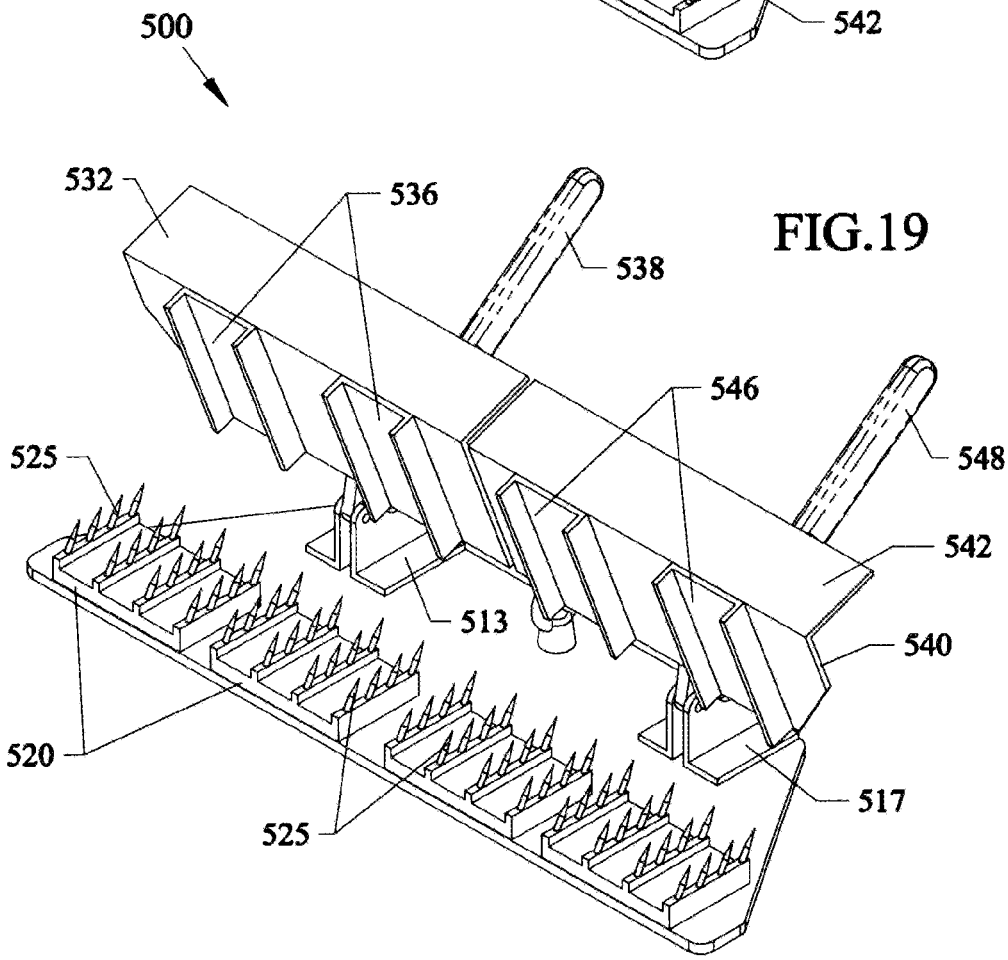

FIG. 19 is an upper front right perspective view of the double clamp lock of FIG. 17 in an open position.

Carpet Grabbing Floor Plate Adapter

Figure 20:
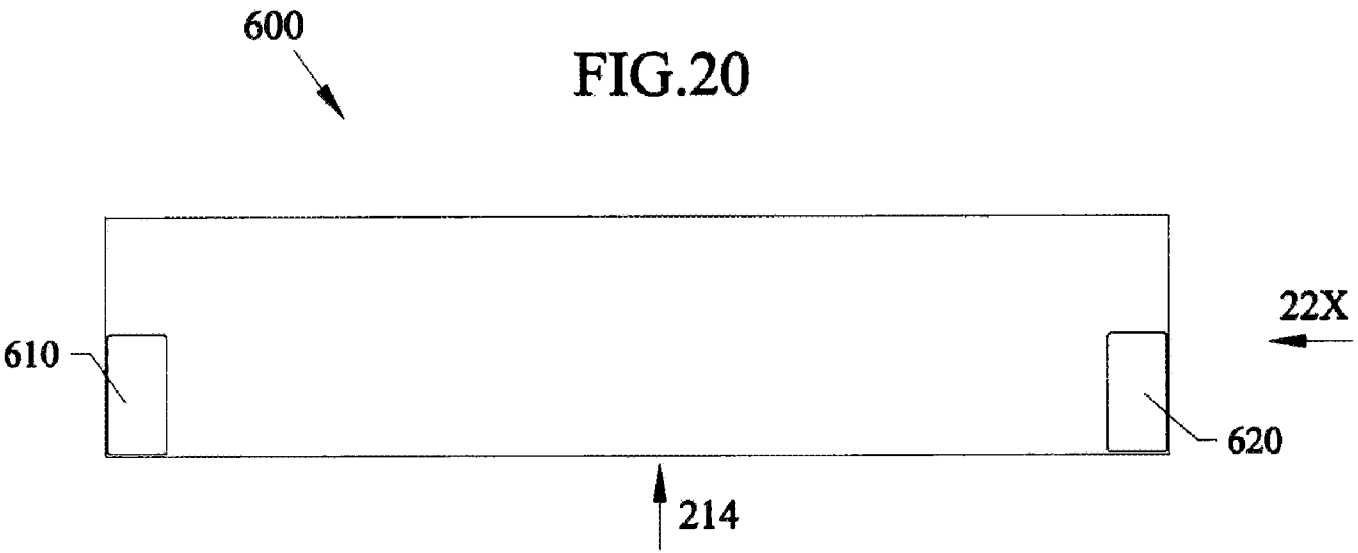

FIG. 20 is a top view of a novel carpet grabbing floor plate for use with the invention.

Figure 21:
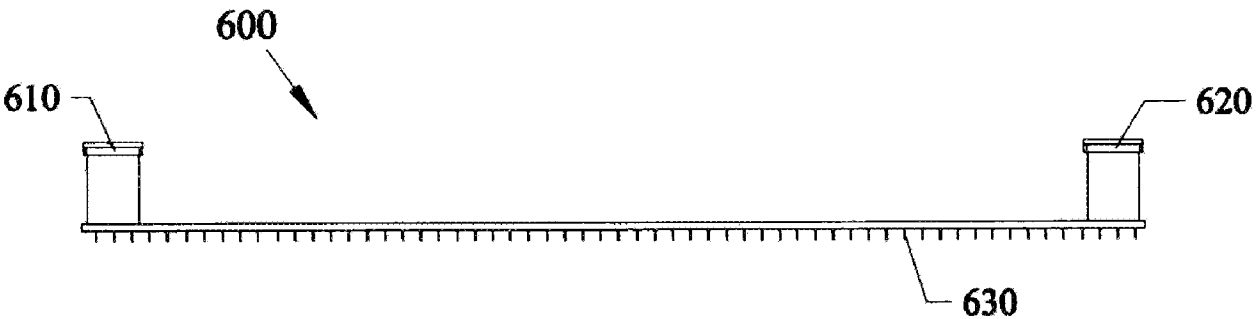

FIG. 21 is a front view of the carpet grabbing floor plate of FIG. 20 along arrow 21Y.

Figure 22:
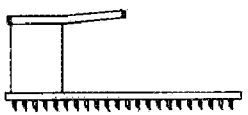

FIG. 22 is a side view of the carpet grabbing floor plate of FIG. 20 along arrow 22X.

Figure 23:
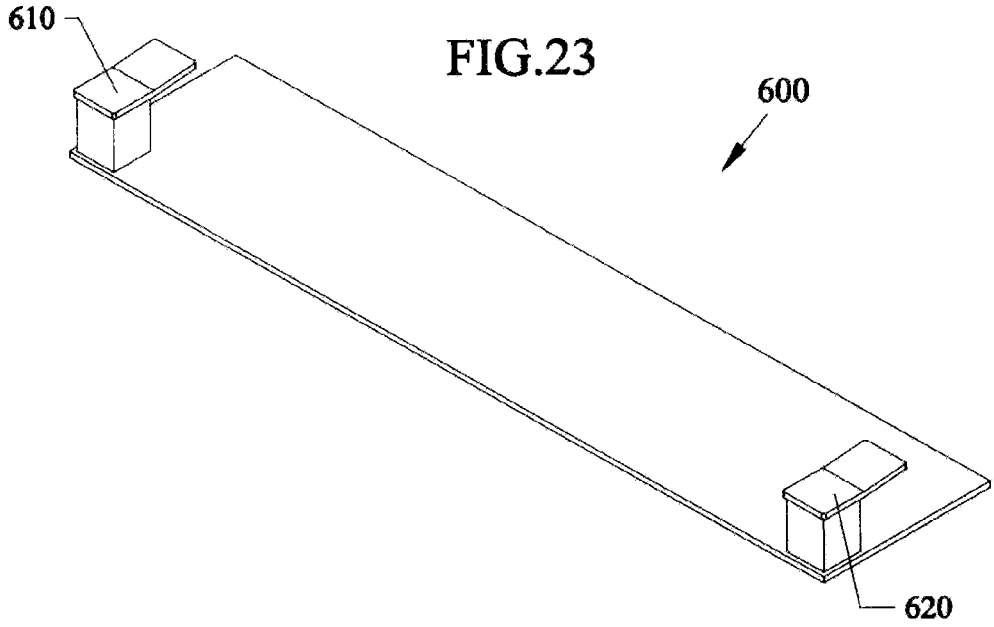

FIG. 23 is a top front right perspective view of the carpet grabbing floor plate of FIG. 20.

Figure 24:
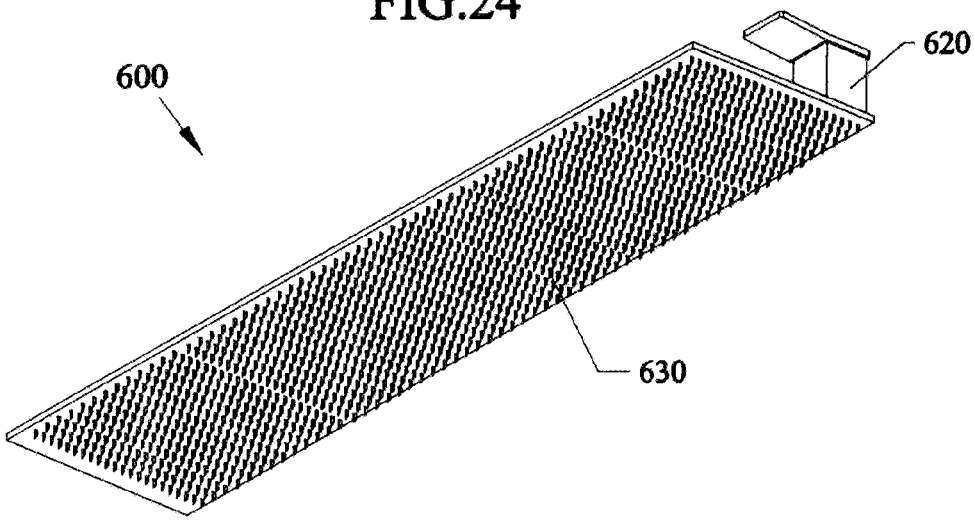

FIG. 24 is a bottom front right perspective view of the carpet grabbing floor plate of FIG. 23.

Figure 25:
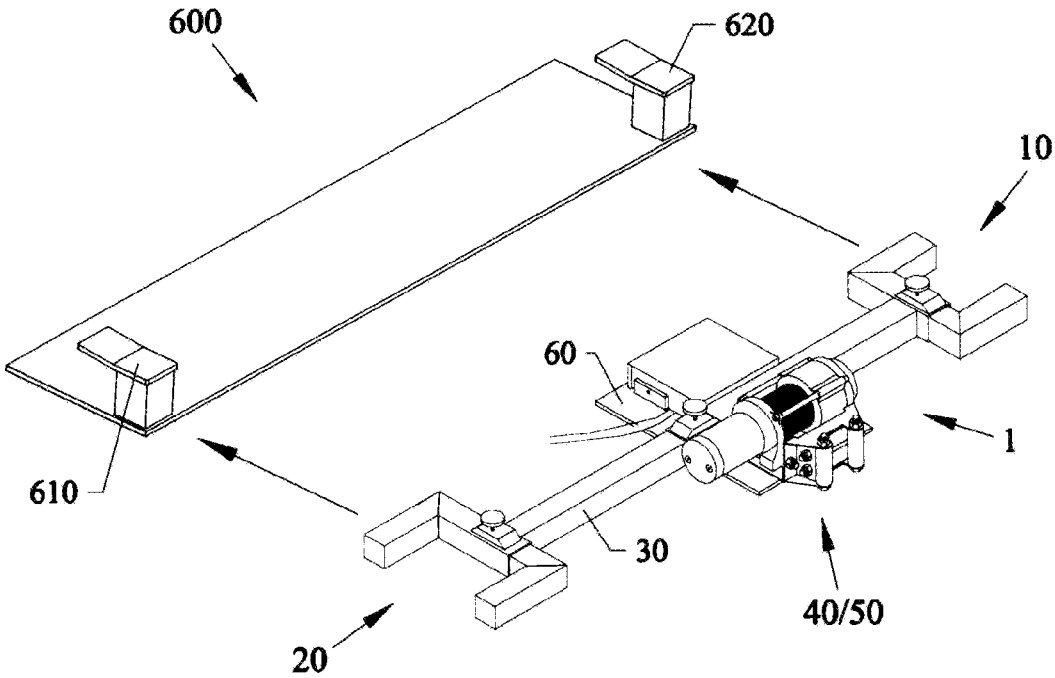

FIG. 25 is an exploded perspective view of the motor/winch with support plate with telescoping bars with clamp ends, about to be attached to the carpet grabbing floor plate.

Figure 26:
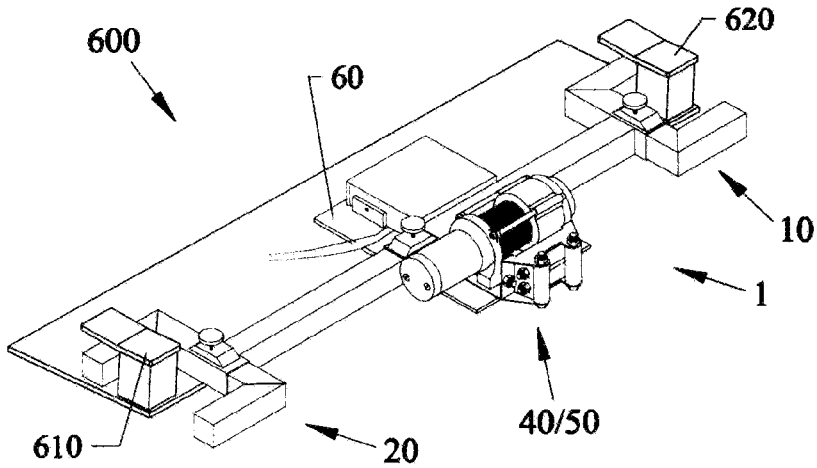

FIG. 26 is a perspective view of the motor/winch with support plate with telescoping bars with clamp ends, attached to the carpet grabbing floor plate.

Figure 27:
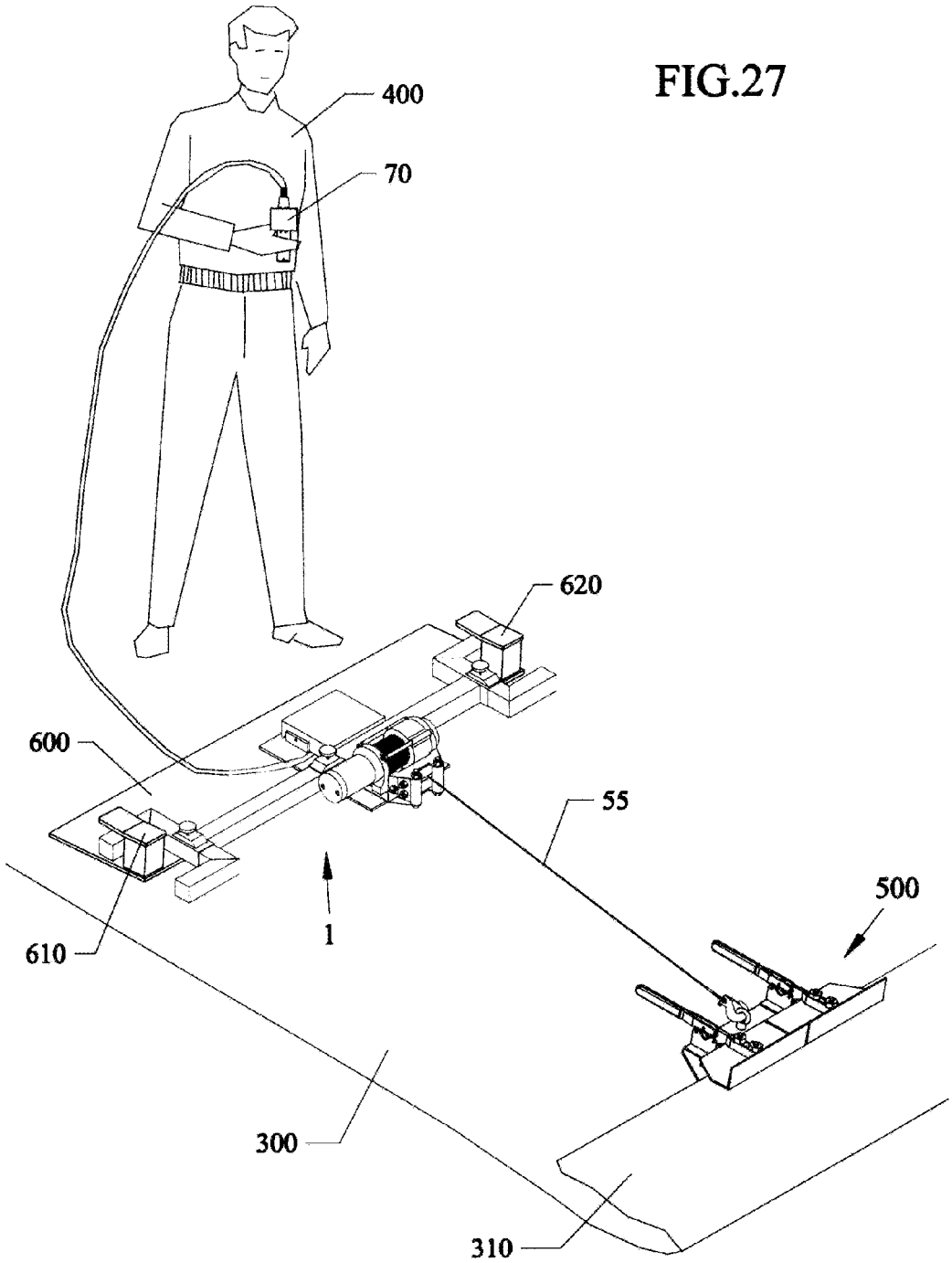

FIG. 27 is a perspective view of the automatic carpet pulling device 1 locked onto the carpet gripping plate 600 of FIG. 26 with the winch pulling by a cable to the double clamp jaws that are locked on a carpet edge.

Carrying Case with Wheel(S)

Figure 28:
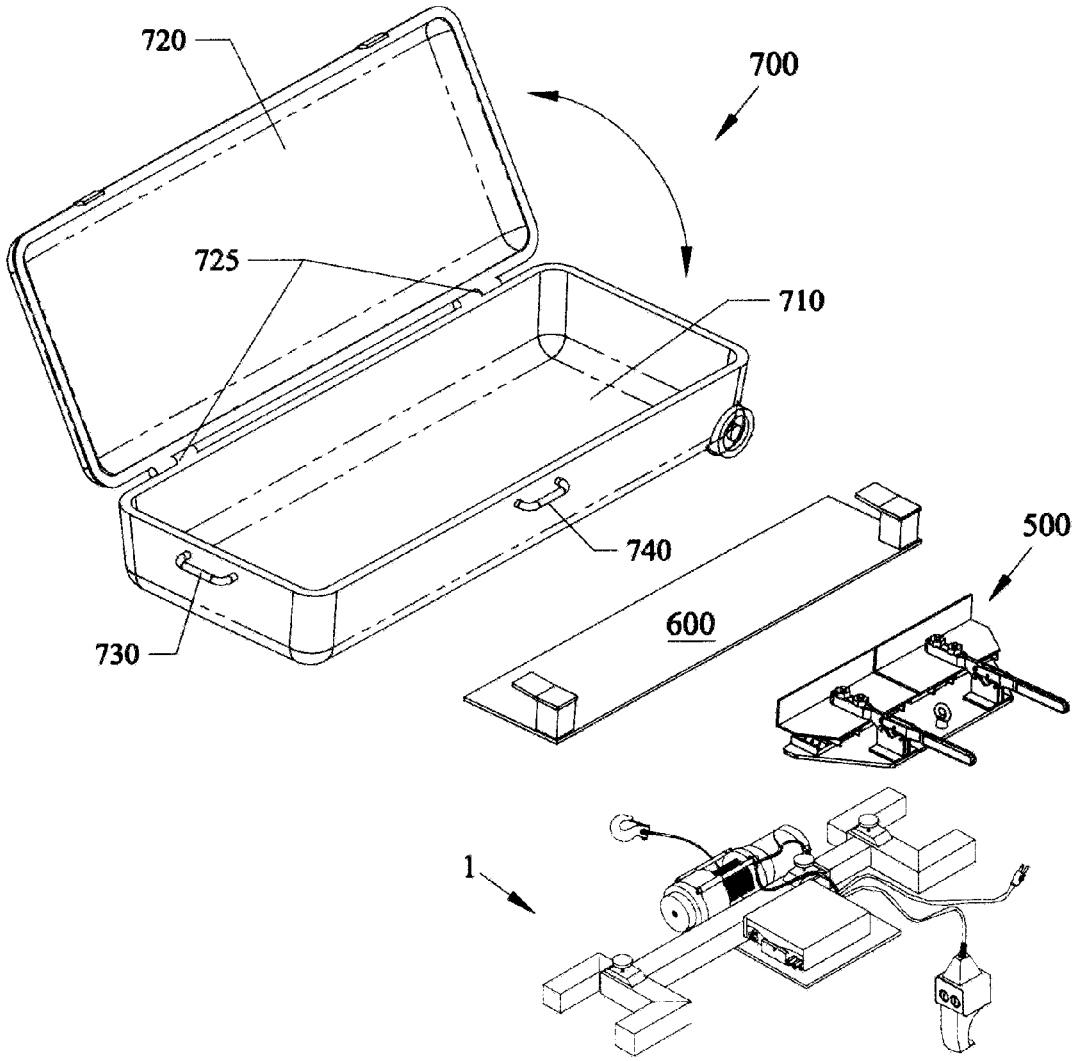

FIG. 28 is an exploded view of a wheeled carrying case, the automatic carpet removing device, carpet grabbing plate and double clamp lock jaws.

Figure 29:
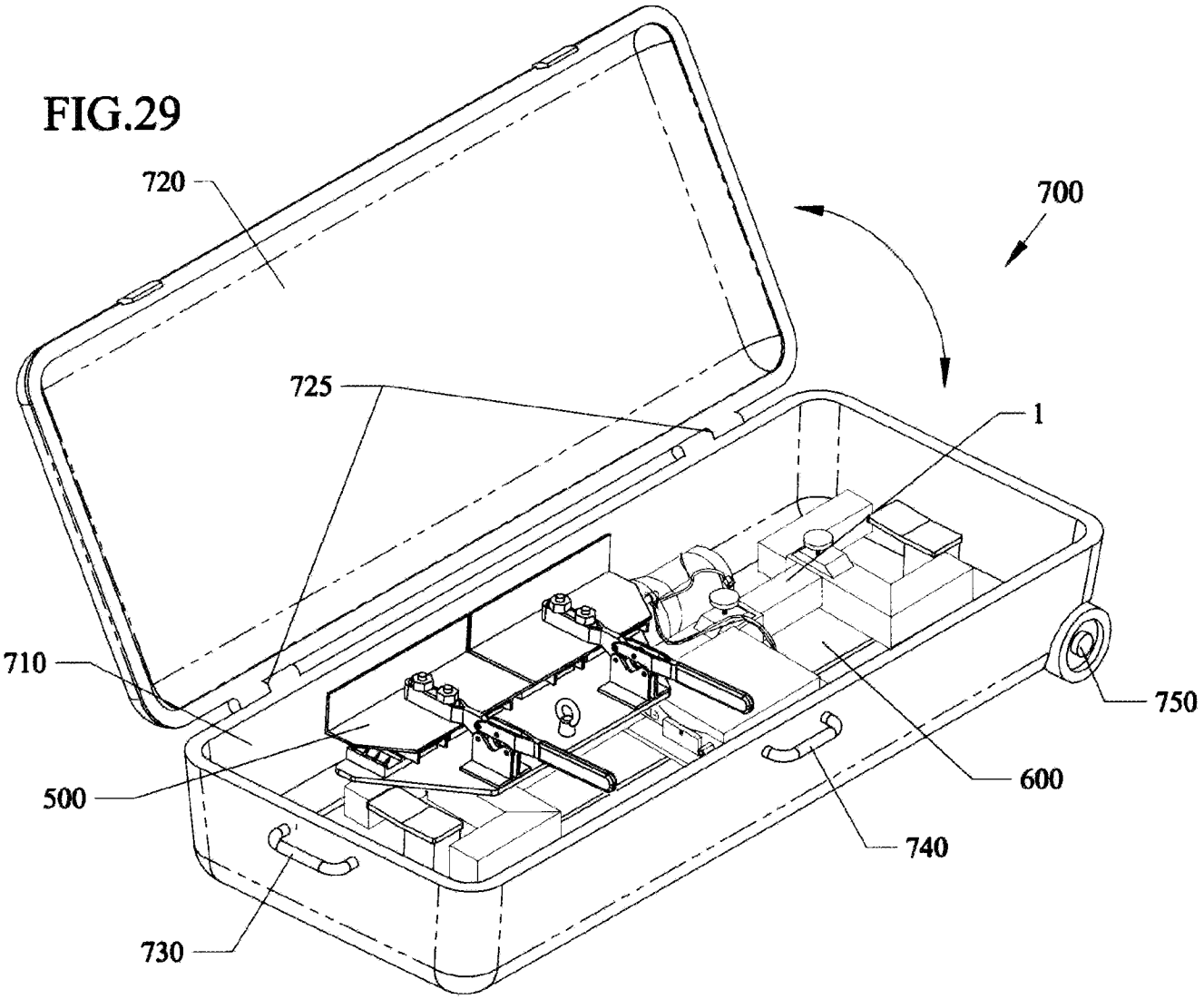

FIG. 29 is a perspective view of the carrying case now holding the automatic carpet removing device, carpet grabbing plate and double clamp lock jaws.

Figure 30:
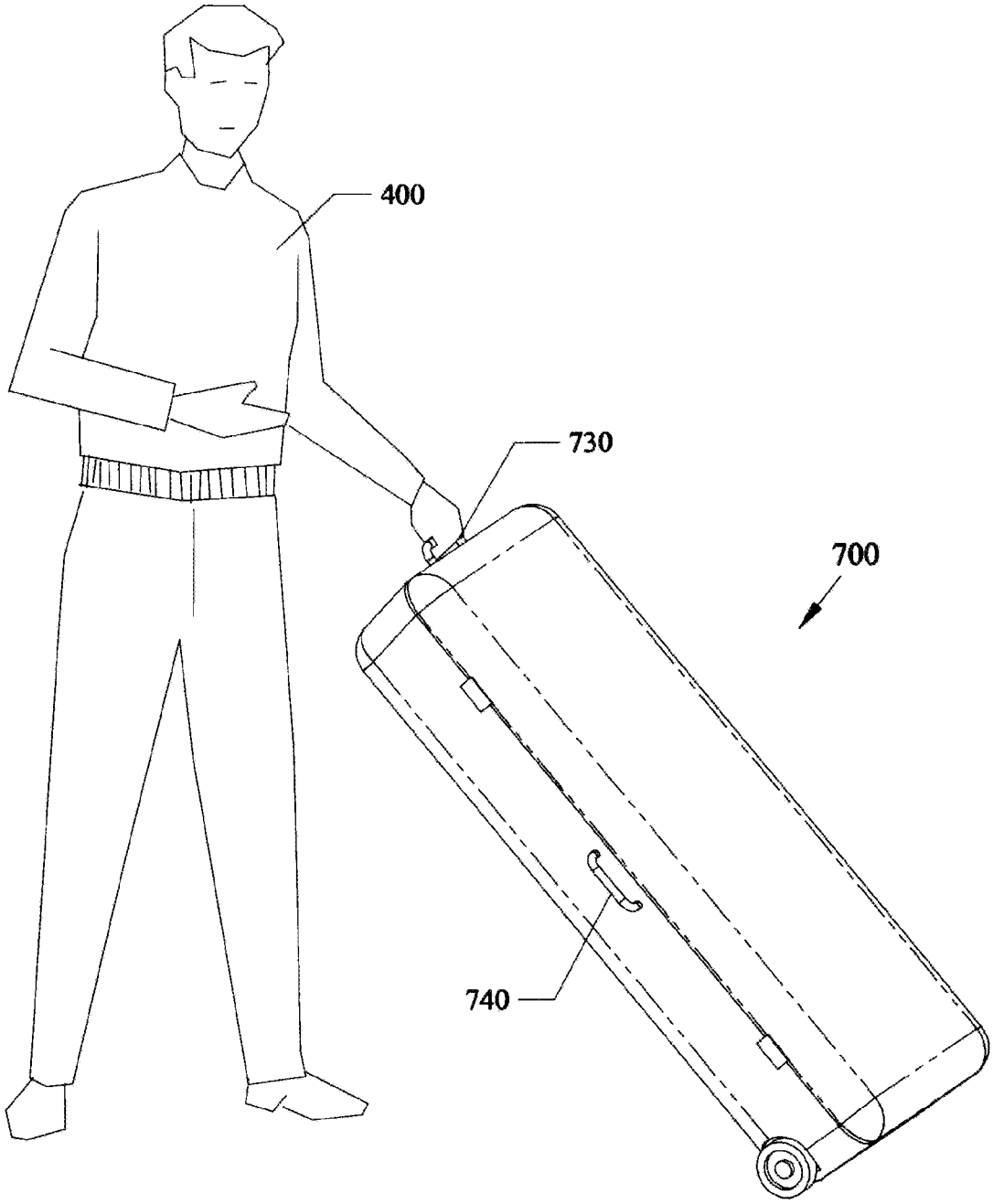

FIG. 30 shows an operator wheeling the carrying case of FIG. 29 that holds the automatic carpet removing device, carpet grabbing plate and double clamp lock jaws.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

The components of the invention will now be described.

1. Automated carpet removing device
10. First doorjamb clamp
12. fixed L-shaped side arm
13. female socket of fixed side arm
14. moveable L-shaped side arm
15. male protruding member of moveable side arm
18. locking screw for first door clamp
20. Second Door jamb clamp
22. fixed L-shaped side arm
23. female socket of fixed side arm
24. moveable L-shaped side arm
25. male protruding member of moveable side arm
28. locking screw for second door clamp
30. Telescoping bars
32. fixed bar
33. female socket end
36. moveable bar
37. male protruding end
38. locking screw for telescoping bars
40. Motor
45. power cord
50. Winch
55. cable
58. hook end of cable
60. Support plate
70. Remote control
80. Doorway
82. First Door jamb
84. Second doorjamb
100. Carpet gripping clamp
200. Expandable clamp embodiment with elongated telescoping bars
230, 240 Additional insert adapters 230, 240
232, 242 Male end
236, 246, Second Fixed L-shaped arm
237, 247, Female Socket
238, 248, Screw down tighteners
300. Carpeting in room/space
310. raised edge of carpeting
400. Operator
Improvements
500. double clamp lock jaws
510. clamp base
513. left rear pivot hinge
517. right rear pivot hinge
518. pivot point
519. pivot point
520. teeth modules
525. rows of teeth
530. left upper jaw
532. left raised front flange
535. rear pivot hinge
536. downwardly extending channel brackets
537. pivot point
538. left handle
539. pivot point
540. right upper jaw
542. right raised front flange
545. rear pivot hinge
546. downwardly extending channel brackets
547. pivot point
548. right handle
549. pivot point
600. carpet grabbing floor plate adapter
610. upper facing left hook
620. upper facing right hook
630. lower facing carpet grabbing teeth
700. carrying case with wheels
710. bottom of case with sidewalls
720. top cover of case
725. hinge for top cover
730. top handle
740. side handle
750. bottom wheel(s)

Figure 2:
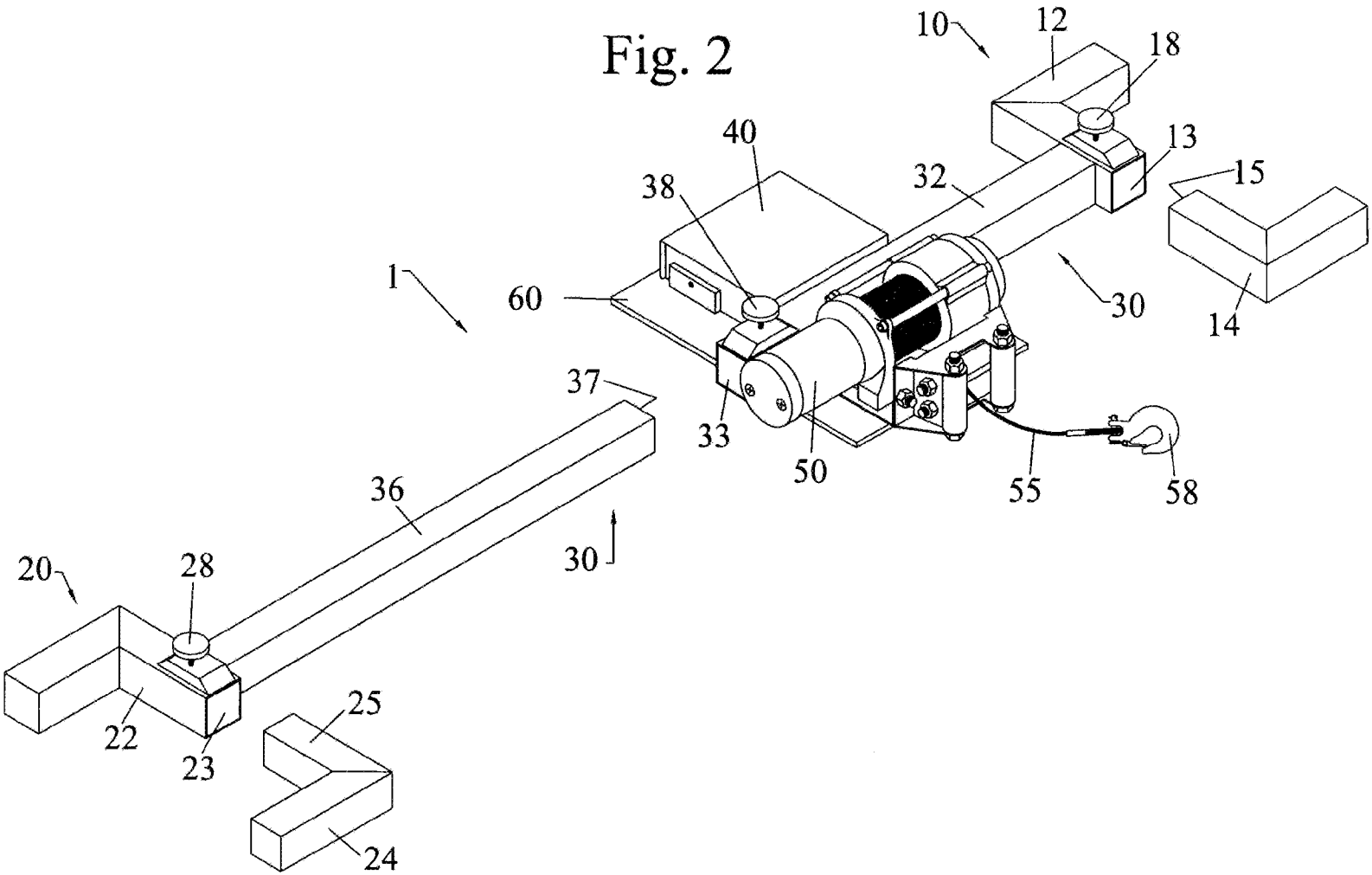
FIG. 2 is an exploded view of the carpet removing device of FIG. 1.
Figure 3:
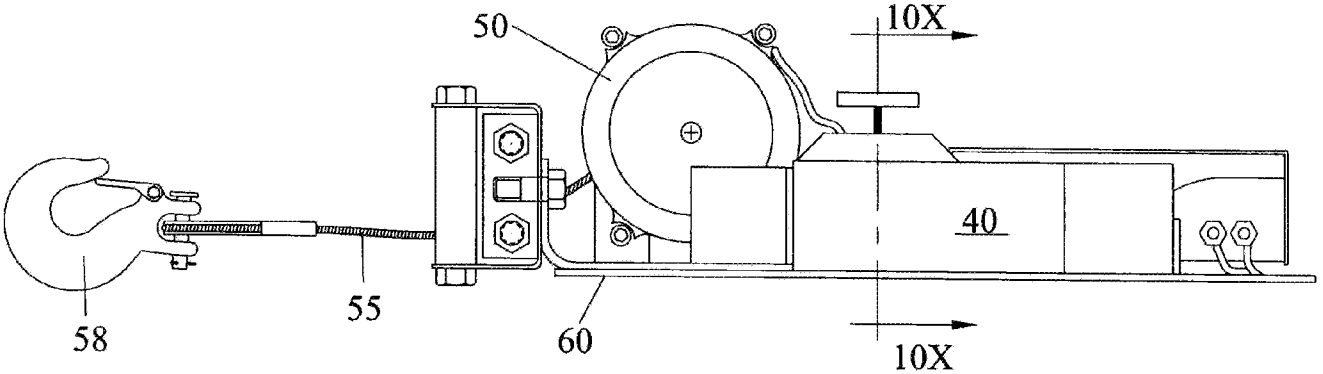
FIG. 3 is a side view of the motor and winch with support plate of the carpeting removing device of FIG. 1.
Figure 4:
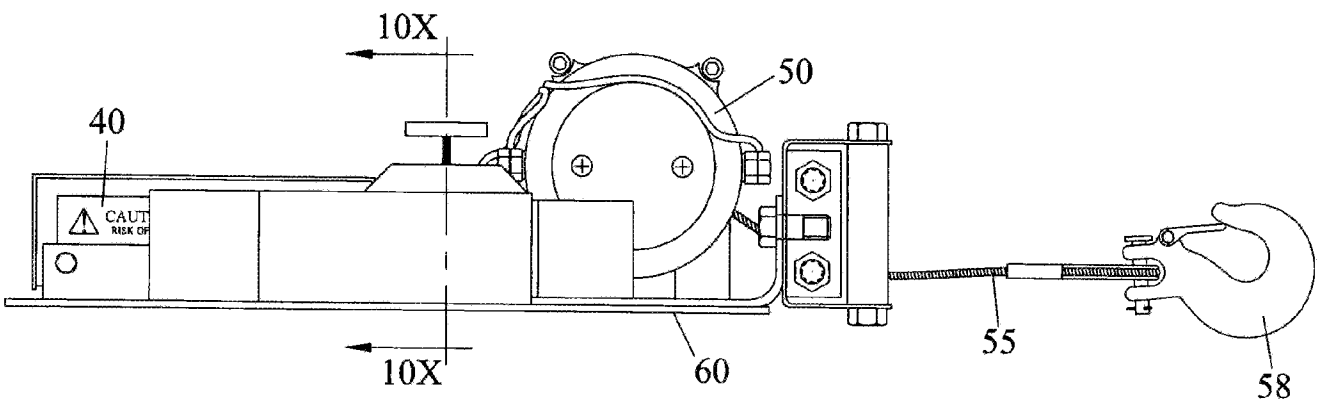
FIG. 4 is an opposite side view of the motor and winch with support plate of the carpeting removing device of FIG. 1.
Figure 5:
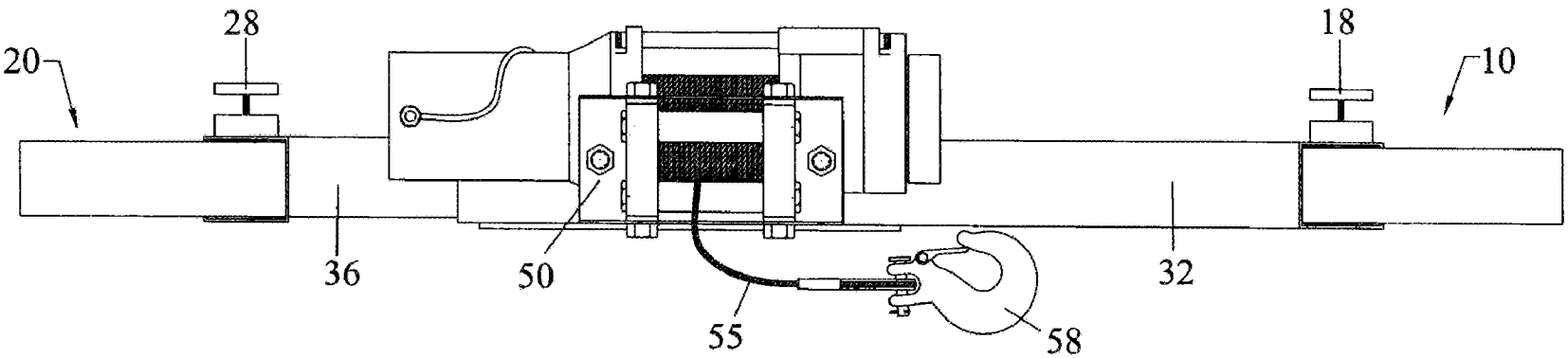
FIG. 5 is a rear side view of the carpet removing device of FIG. 1.
Figure 6:
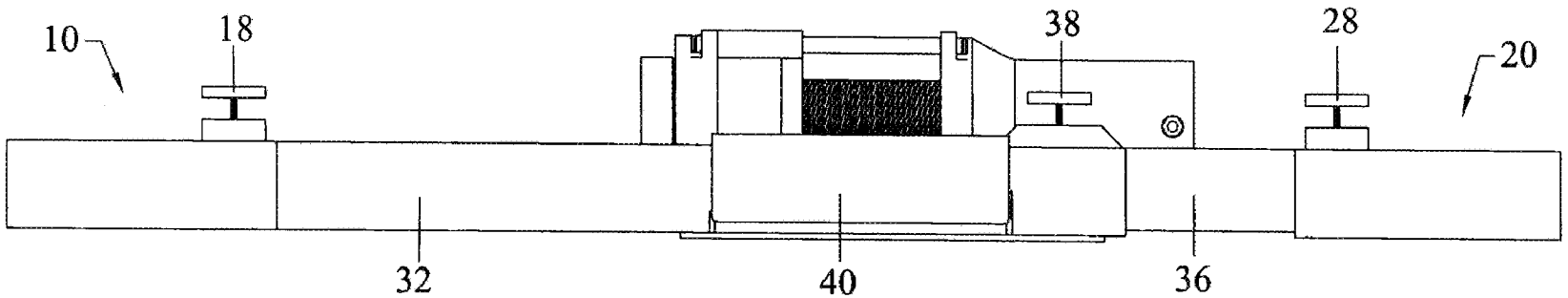
FIG. 6 is a front side view of the carpet removing device of FIG. 1.
Figure 7:
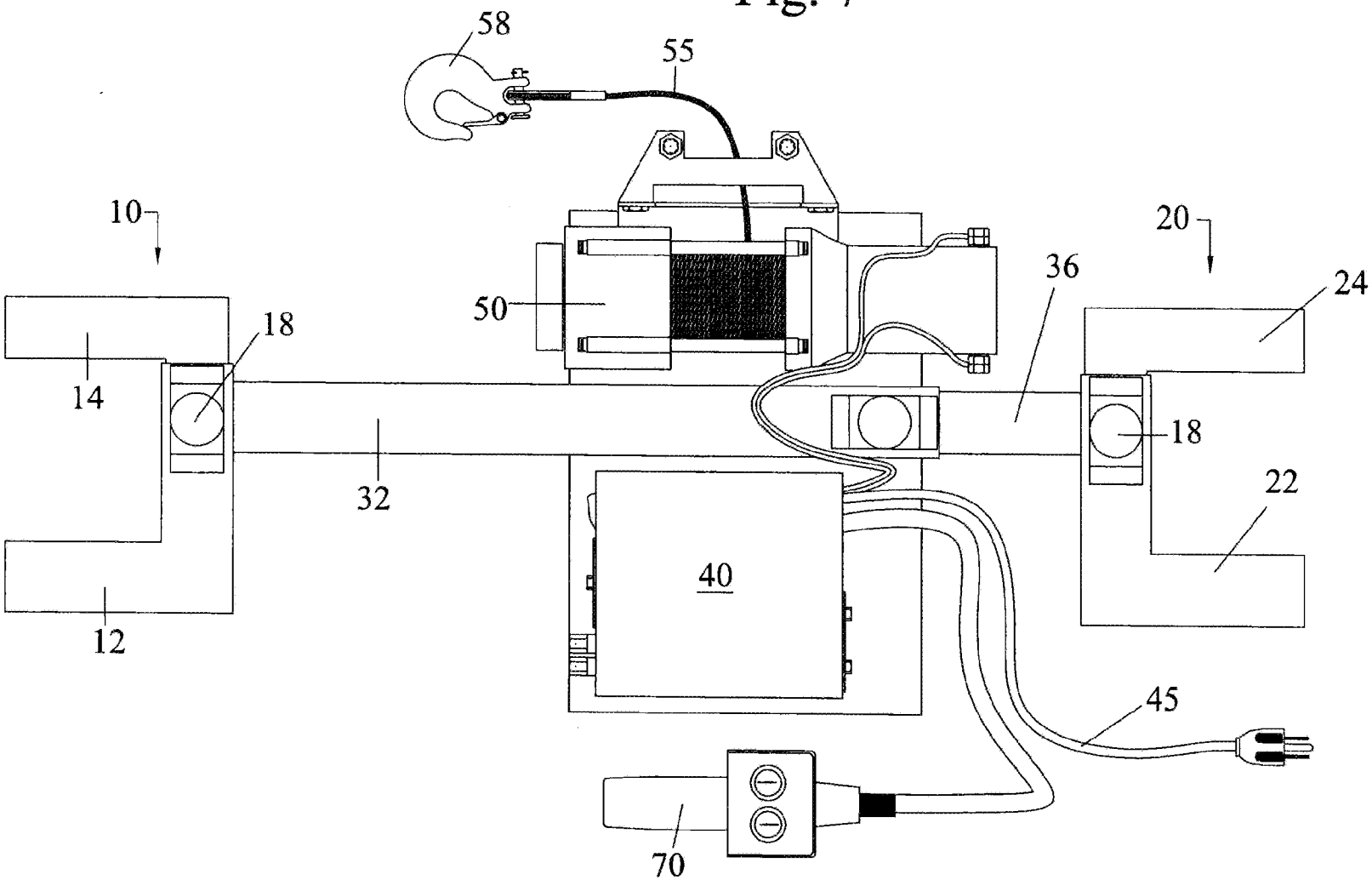
FIG. 7 is a top view of the carpet removing device of FIG. 1.
Figure 8:
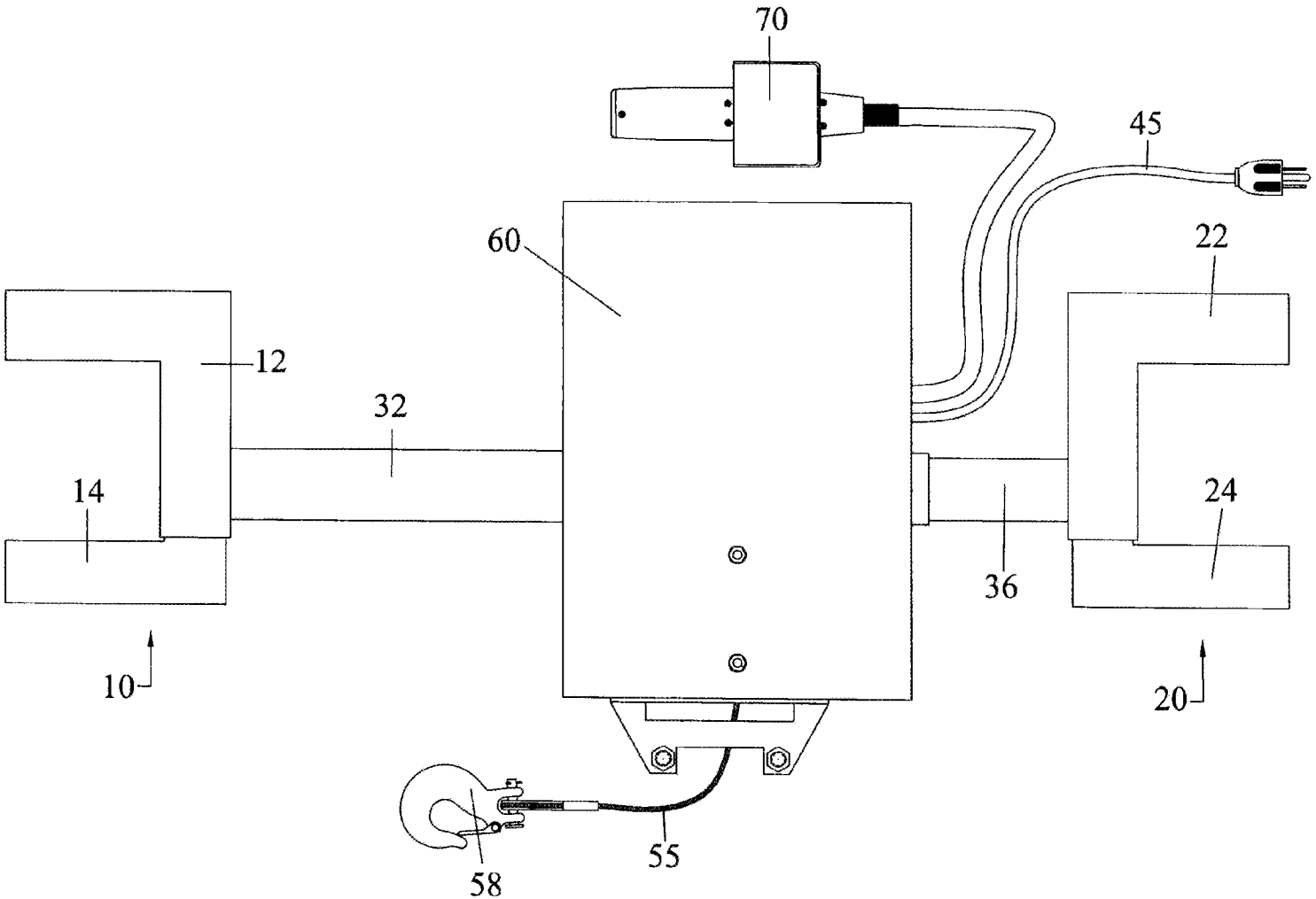
FIG. 8 is a bottom view of the carpet removing device of FIG. 1.

FIG. 1 is an upper perspective view of the novel carpet removing device 1. FIG. 2 is an exploded view of the carpet removing device 1 of FIG. 1. FIG. 3 is a side view of the motor and winch with support plate of the carpeting removing device of FIG. 1. FIG. 4 is an opposite side view of the motor 40 and winch 50 with support plate 60 of the carpeting removing device 1 of FIG. 1. FIG. 5 is a rear side view of the carpet removing device 1 of FIG. 1. FIG. 6 is a front side view of the carpet removing device 1 of FIG. 1. FIG. 7 is a top view of the carpet removing device 1 of FIG. 1. FIG. 8 is a bottom view of the carpet removing device 1 of FIG. 1.

Referring to FIGS. 1-8, the carpet removing device can include an electrical motor 40, such as 12 volt motor that is powered by a wall plug 45. The motor can run a winch 50 having a rotatable drum with a elongated line 55, such as a cabled wrapped thereon. At the end of the cable 55 can be a hook end 58 for attachment to a carpet edge clamp that will be described later. The motor 40 and winch 50 can be fastened to a support plate 60.

Attached to the support plate 60 can be telescoping bars 30. One bar 32 can be fixed to the support plate 60 between the motor 40 and winch 50. The fixed bar 32 can have a open female socket end 33 at one end. A second bar 36 can have a male protruding end 37 which can be telescopingly received within the female socket end 33 of the fixed bar 32. A tightening thumb type screw 38 can be attached to pass through the top of female socket end 33 of the fixed bar 32 in order to tighten against the upper surface of male protruding end 37 of the telescoping bar 36. Moving the male protruding end 37 of the telescoping bar 36 in and out of female socket end 33 of fixed bar 32 can adjust the length of the telescoping bars 30.

The opposite end of the fixed bar 32 can be attached to a fixed L-shaped arm 12 of a first doorjamb clamp 10. The fixed arm 12 can have an open end with a female socket 13, so that the male protruding end 15 of a moveable L-shaped side arm 14 can be inserted therein. A locking screw 18 can pass through the top of female socket end 13 to abut against the top of male protruding end 15 so that the width of the clamp 10 can be adjusted in size for different sized doorjambs.

The opposite end of the moveable bar 36 can be attached to a fixed L-shaped arm 22 of a second doorjamb clamp 20. The fixed arm 22 can have an open end with a female socket 23, so that the male protruding end 25 of a moveable L-shaped side arm 24 can be inserted therein. A locking screw 28 can pass through the top of female socket end 23 to abut against the top of male protruding end 25 so that the width of the clamp 20 can be adjusted in size for different sized doorjambs.

A remote control 70 can be tethered to the motor 40 so that an operator can turn on and off the winch from a remote location. Alternatively, the remote control can be battery operated, and be wireless for activating the motor for the winch.

Figure 9:
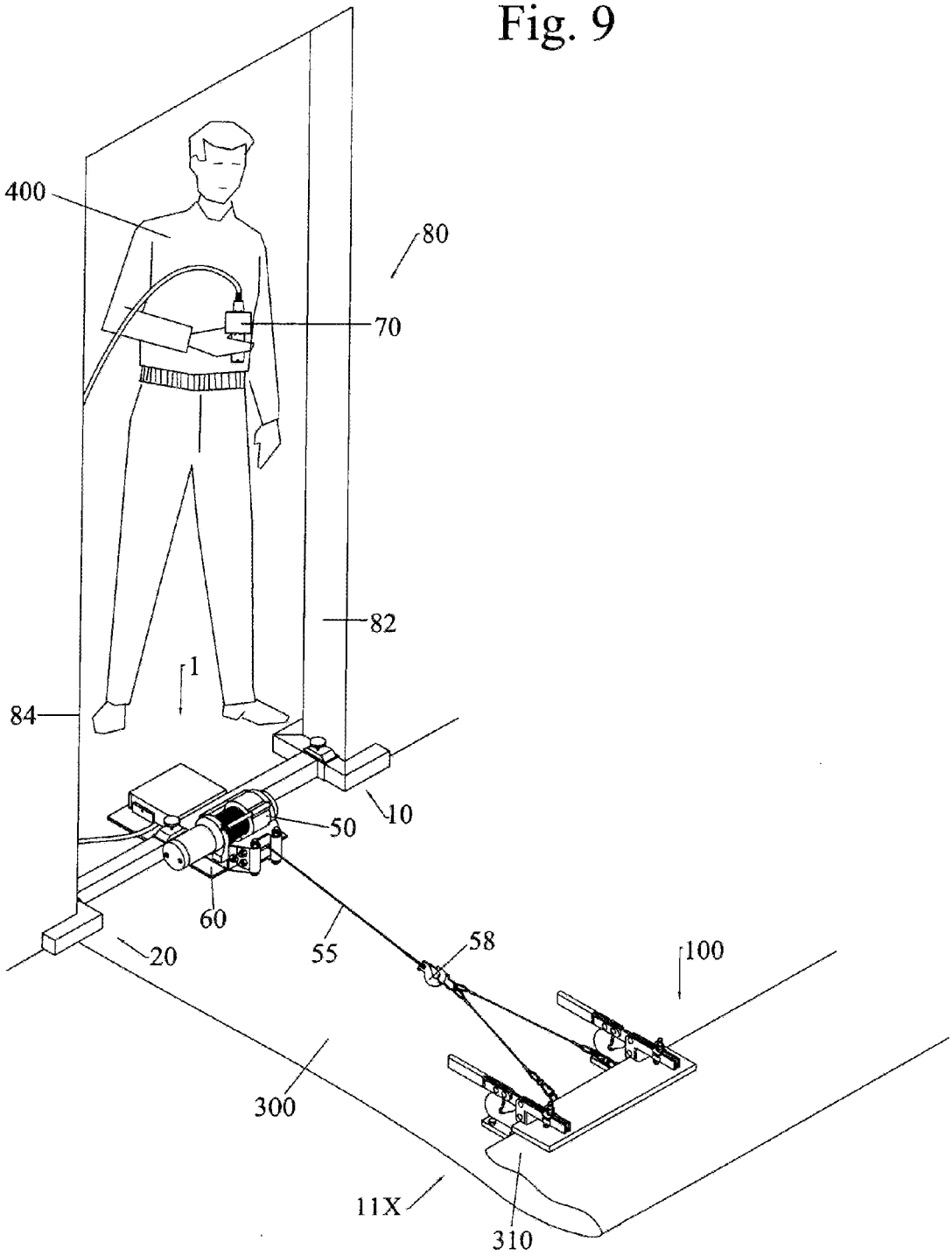
FIG. 9 shows the carpet removing device attached to a doorjambs of a doorway with a gripping clamp about a raised edge of a carpet.
Figure 10:
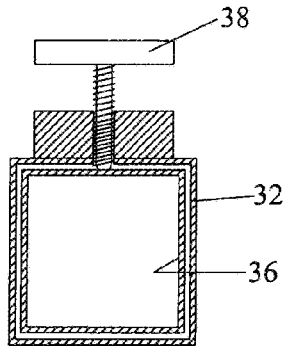
FIG. 10 is an enlarged cross-sectional view of the telescoping bar section of FIGS. 3-4 along arrows 10X.
Figure 11:
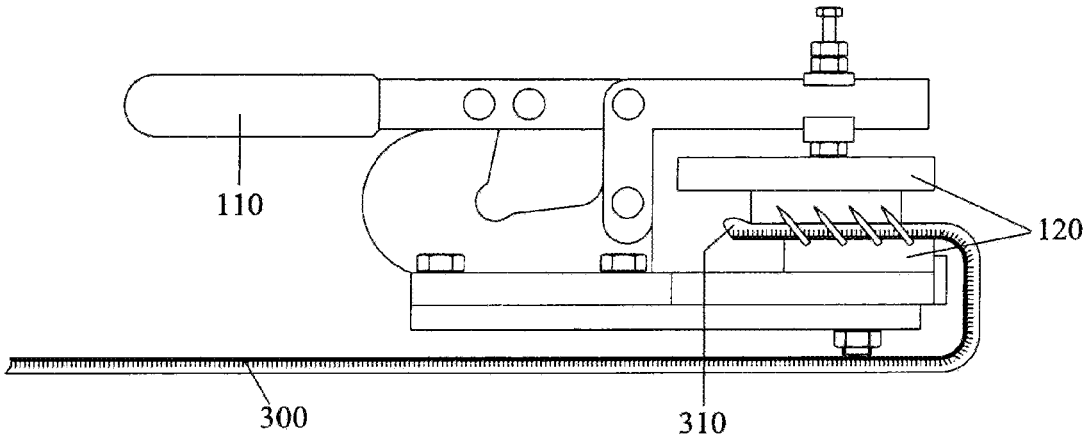
FIG. 11 is an enlarged side view of the gripping clamp of FIG. 9 along arrow 11X.

FIG. 9 shows the carpet removing device 1 attached to a doorjambs of a doorway with a gripping clamp 100 about a raised edge 310 of a carpet 300. FIG. 10 is an enlarged cross-sectional view of the telescoping bar section of bars 32, 36 and locking screw 38 of FIGS. 3-4 along arrows 10X. FIG. 11 is an enlarged side view of the gripping clamp 100 of FIG. 9 along arrow 11X with adjustable handle 110 and pair of clamp teeth 120. A raised edge 310 of carpet can be inserted between teeth 120 and locked in place by pushing down on handle 110. The carpet gripping clamp 100 can be such as but not limited to the gripping jaw assembly 20 shown and described in reference to U.S. Pat. No. 4,533,118 to Thomas et al., which is incorporated by reference.

Referring to FIGS. 9-11 and 1-8, the operator can attach each of the clamps 10, 20 about side edges of a first doorjamb 82 and a second doorjamb 84 of a doorway, by wrapping each of the L-shaped arms of the clamps 10, 20 about the respective doorjamb and tightening the attachment with respective locking screws 18, 28. Here the motor 40 and winch 50 with support plate 60 can sit directly in the actual doorway 80 of the room where the carpet 300 is to be removed. Next, the gripping clamp 100 can be attached to the hook end 58 of the elongated line (such as a cable) 55. The operator 400 can stand behind the doorway 80 outside of the room in which the carpet 300 is to be removed. To activate the device 1, the operator 400 merely needs to turn on and off the winch 50 to start pulling the elongated line 55 about the drum of the winch 50 and pulls up the carpet edge 310 which results in removing the carpeting 300 from the space.

Figure 12:
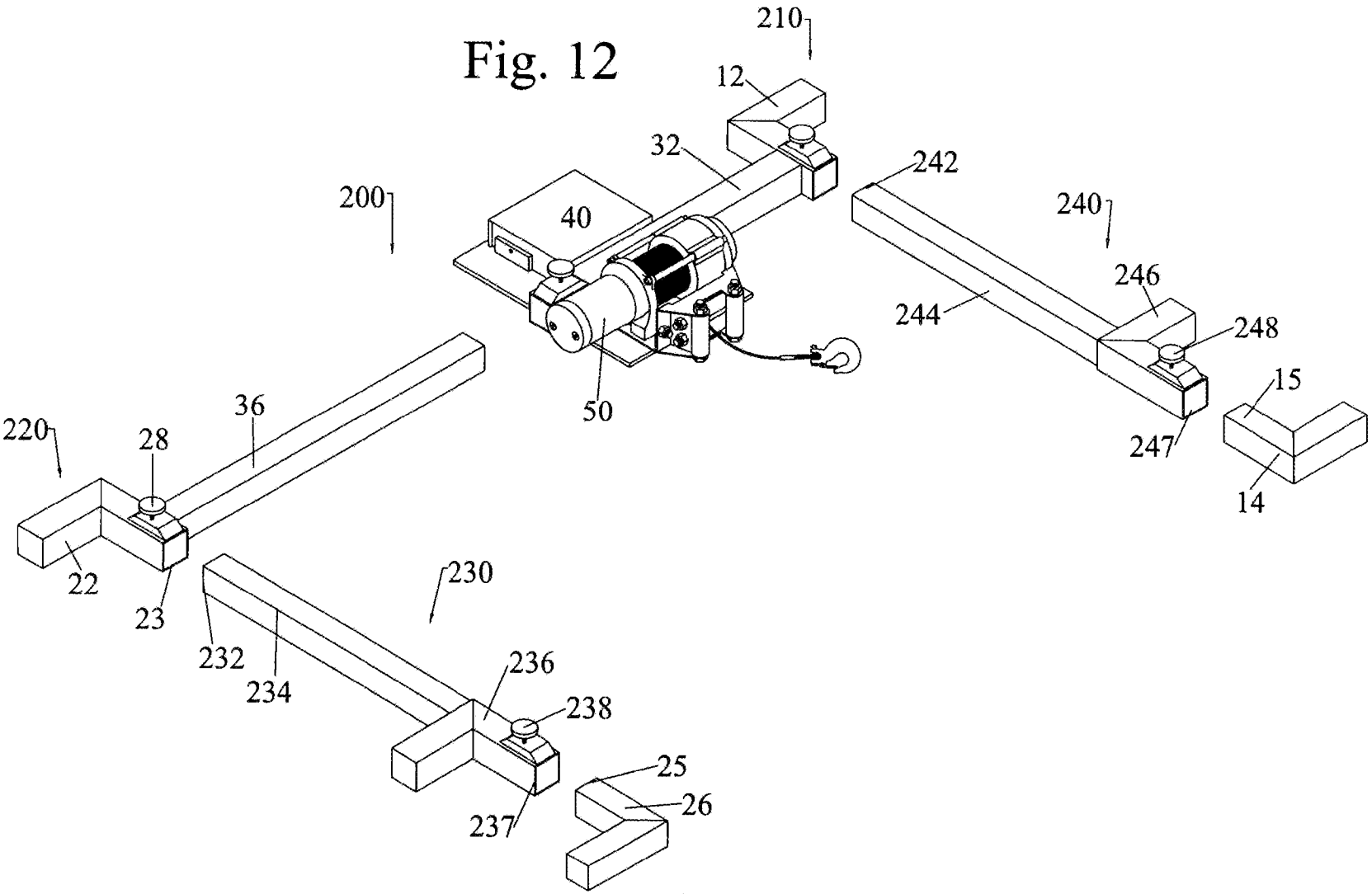
FIG. 12 is an exploded view of a second version of the clamp ends of the telescoping bars of the novel carpet removing device.
Figure 13:
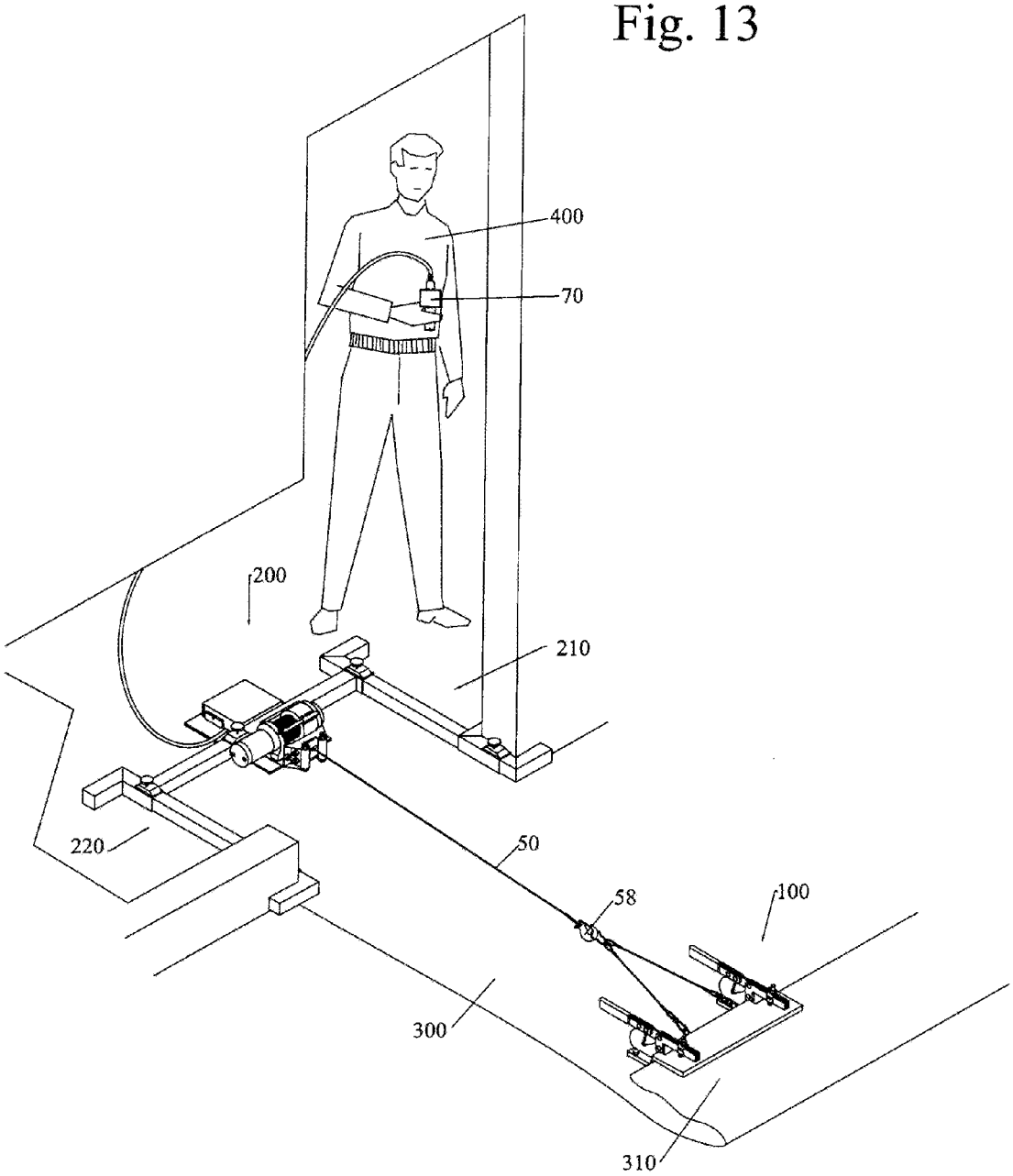
FIG. 13 shows the carpet removing device attached to the doorjambs of a doorway so that the winch and motor sits outside of the room in which the carpet is to be removed.

FIG. 12 is an exploded view of a second version 200 of the clamp ends of the telescoping bars of the novel carpet removing device 200. FIG. 13 shows the carpet removing device 200 attached to the doorjambs 82, 84 of a doorway 80 so that the winch 50 and motor 40 sits outside of the room in which the carpet is to be removed.

This version has the same components as the former carpet removing device, with the exception of adding an additional insert adapters 230, 240 so as to be able to space the support 60 with winch 50 and motor 40 outside of the doorway 80 and into a different space/room than which the carpet 300 is to be removed. Here, the male end 232 of the adapter 230 telescopingly is inserted into the female socket 23 of the fixed L-shaped arm 22. Next, the male protruding end 25 of the moveable L-shaped arm 26 is inserted into the female socket end 237 of the second fixed L-shaped arm 236. The screws 28 and 238 can adjust the lengths of the bar 234 so as to customize the amount of distance for placing the support 60 with winch 50 and motor 40 outside of the room where the carpet is to be removed. Likewise, the second adapter 240, has components 242, 244, 246, 247, 248 which function similarly with L-shaped arms 12 and 14.

The carpet gripping clamp can also be two parallel bars that can be bolted together with screws/bolts that can pass through a carpet edge that is inserted between the bars. One bar can move relative to another bar so as to tightly grip the carpet edge.

The doorway clamps can also be positioned in a window frame as needed.

The novel device can weigh between approximately 50 to approximately 60 pounds so as to be carriable and can be operated by a single operator. The prior art machines often require two or more operators to carry and operate, and can weigh over 150 pounds.

Although the invention is described as being used to remove carpeting, the invention can be adapted to remove other types of rolled down flooring, such as but not limited to rubber flooring, vinyl flooring, and the like.

While the winch is described as being electrically powered with a wall mounted power plug, the winch can be powered by other batteries, and the like. Alternatively, the winch can be powered by other sources, such as but not limited to gas and the like.

Although the invention is described for removing glued down carpeting, the invention has other applications such as but not limited to removing carpeting that is nailed down, and fastened in other ways to a floor surface.

Improvements

Double Clamp Lock Jaws

FIG. 14 is a top view of a novel double clamp lock jaws 500 for a carpet edge in lock position. FIG. 15 is a front view of the double clamp lock jaws 500 of FIG. 14 along arrow 15Y. FIG. 16 is a right side view of the double clamp lock jaws 500 of FIG. 14 along arrow 16X. FIG. 17 is another right side view of the double clamp lock jaws 500 of FIG. 16 with the upper jaws 530, 540 in an open position. FIG. 18 is an upper front right perspective view of the double clamp lock jaws 500 of FIG. 1 in a lock position. FIG. 19 is an upper front right perspective view of the double clamp lock jaws 500 of FIG. 17 in an open position.

Referring to FIGS. 14-19, the double clamp lock jaws 500 have a single base plate 510 with a plurality of teeth modules 520, each having rows of raised teeth 525 that can be upwardly at an upward rear facing angle. The angled teeth allow for enhanced gripping action into a carpet edge being grabbed, since the pulling on the double clamp lock jaws allows for pushing the teeth 525 deeper into the carpet edge. Two handle (538, 548) controlled upper jaws 530, 540 are hingedly attached by respective rear pivot hinges 535, 545 to respective rear pivot hinges 513, 517 of the base plate 510. The lower surface of the upper jaws 530, 540 have downwardly extending channel brackets 536, 546 that when closed pass between the rows of the teeth 525. The channel brackets 536, 546 each have pairs of downwardly extending flanges that form additional gripping capability to a carpet edge that is inserted into a closed position of the lock jaws 500. In addition, the two separate upper jaws 530, 540 allow for a greater grip on a carpet edge than a single pivotable jaw of the prior art.

Each upper jaw 530, 540 can pivot from a closed lock position as shown in FIGS. 16 and 18 to an unlocked raised position as shown in FIGS. 17 and 19, by raising respective handles 538, 548. Here, the upper jaws 530, 540 rotate relative to hinges 535, 545 attached at pivot points 516 (only right one is labeled) to base pivot hinges 513, 517. Each handle 538, 548 has a lower end that connects by two pivot points 547 and 549, 537 and 539, to respective upper rear pivot hinges 535, 545 and extension members 519 (only right one is labeled), the latter of which is pivotally attached at pivot point 518 (only right one is labeled) to base pivot hinges 513, 517.

Each of the upper jaws 530, 540 can include respective raised front flanges 532, 542 that can function as a safety abutment for users.

Carpet Grabbing Floor Plate Adapter

FIG. 20 is a top view of a novel carpet grabbing floor plate 600 for use with the invention. FIG. 21 is a front view of the carpet grabbing floor plate 600 of FIG. 20 along arrow 21Y. FIG. 22 is a side view of the carpet grabbing floor plate 600 of FIG. 20 along arrow 22X. FIG. 23 is a top front right perspective view of the carpet grabbing floor plate 600 of FIG. 20. FIG. 24 is a bottom front right perspective view of the carpet grabbing floor plate 600 of FIG. 23.

Referring to FIGS. 20-24, the carpet grabbing plate adapter 600 includes upper facing left hook 610, and upper facing right hook 620 on opposite ends of the plate adapter 600. On the lower surface of the plate can be downwardly extending carpet teeth 630 that are substantially uniformly densely spaced on the bottom of the plate 600.

FIG. 25 is an exploded perspective view of the motor/winch with support plate with telescoping bars with clamp ends, about to be attached to the carpet grabbing floor plate. FIG. 26 is a perspective view of the motor/winch 40/50 with support plate with telescoping bars 30 with door jamb clamps 10, 20, attached to the carpet grabbing floor plate 600. FIG. 27 is a perspective view of the automatic carpet removing device 1 locked to carpet grabbing plate 600 of FIG. 26, with the winch pulling by a cable to the double clamp jaws 500 that are locked on a carpet edge 310.

Referring to FIGS. 20-27, the carpet grabbing plate adapter 600 allows for the automatic carpet removing device 1 to be floor mounted, without any fasteners that have to pass into the flooring below the carpet 300, and without having to mount the device 1 in a doorway. The bottom of the plate 600 is substantially covered with downwardly protruding teeth 630, that allow the plate 600 to grab onto the carpet 300 when the plate 600 sits on the carpet 300. The operator 400 can stand on the plate 600 to increase the teeth penetration and locking capability of the teeth 630 into the carpet 300. Next, the operator 400 can position the clamp ends 10, 20 of the telescoping bars 30 that are attached to the winch/motor 40/50, about the C shaped hooks 610, 620 located on the opposite ends of the upper surface of the plate 600. The telescoping bar 30 can be expanded (as described in the previous embodiment) until the clamps 10, 20 lock into the C hooks 620, 610. The closed side of the C hooks 610, 620 further holds the clamp ends 20, 10 of the telescoping bars 30 that is attached to the winch/motor 40/50, since the pulling action is against the closed side of the C hooks 610, 620. The double lock jaws 500 can be locked about a raised carpet edge 310 spaced away from the gripping plate 600. The operator 400 can use the handheld remote 70 to operate the motor/winch 40/50 to retract the cable 55 and start pulling up the carpet 300 by clamped carpet edge 310.

Carrying Case with Wheel(S)

FIG. 28 is an exploded view of an open wheeled carrying case 700, the automatic carpet removing device 1, carpet grabbing plate 600 and double clamp lock jaws 500. FIG. 29 is a perspective view of the carrying case 700 now holding the automatic carpet removing device 1, carpet grabbing plate 600 and double clamp lock jaws 500. FIG. 30 shows an operator 400 wheeling the carrying case 700 of FIG. 29 that holds the automatic carpet removing device 1, carpet grabbing plate 600 and double clamp lock jaws 500.

Referring to FIGS. 28-30, a novel carrying case 700 can effectively be used to store the automatic carpet removing device 1, carpet grabbing plate 600 and double clamp lock jaws 500. The case 700 can have one or more wheels 750 on one end that allows the case 700 to be wheeled about similar to luggage having wheels. The installer can position pickup the filled case 700 and raise one end of the case by the top handle 730 so that the other end of the case 700 can be rolled about by wheel(s) 750. Another side handle 740 can allow for the case 700 to be carried with one hand of the user without using the wheels 750. The carrying case 700 adds another level of portability and mobility over the prior art, where the case can easily be rolled into position for carpet removal and then rolled out of the space to another job site.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An automated carpet removing device, comprising:

a motor powered winch having an elongated line rolled thereon, the line having an outer end;

a carpet gripper attached to the outer end of the line adapted for gripping a raised edge of a carpet; and an expandable anchor member having opposite facing clamp ends; and an adapter plate for mounting the winch on a portion of the carpet spaced apart from the carpet grabber, wherein the adaptor plate is separable from the winch and the anchor member.

2. The automated carpet removing device of claim 1, wherein the expandable anchor includes:

telescoping bars having a first outer end and a second outer end.

3. The automated carpet removing device of claim 2, wherein the expandable anchor further includes:

a first clamp attached to the first outer end that clamps about a first vertical frame member of a doorjamb; and a second outer clamp attached to the second outer end that clamps about a second vertical frame member of the doorjamb.

4. The automated carpet removing device of claim 3, wherein the first clamp and the second clamp each include an elongated telescoping member for allowing the first clamp and the second clamp to expand or contract about different widths of the doorjamb, and mount the winch outside the room in which the carpet is being removed.

5. The automated carpet removing device of claim 1, wherein the adaptor plate includes:

a lower surface with gripping teeth; and an upper surface having two C shaped hooks, wherein the opposite facing clamp ends lock into the C shaped hooks on the upper surface of the adaptor plate.

6. The automated carpet removing device of claim 1, wherein the carpet edge gripper includes:

a carpet edge clamp with double operable jaws having gripping teeth for locking about the raised edge of the carpet.

7. The automated carpet removing device of claim 6, wherein the carpet edge clamp includes:

two handles for separately operating each of the double jaws.

8. The automated carpet removing device of claim 6, wherein the carpet edge clamp includes:

a pair of pivotable upper jaws; and a single base having raised teeth on an upper surface.

9. The automated carpet removing device of claim 8, wherein the upper jaws includes: downwardly protruding channels extending below the upper jaws.

10. The automated carpet removing device of claim 1, further comprising:

a carrying case having at least one wheel for allowing the device to be stored inside and be both portable and rollable.

11. An automated carpet removing device, comprising:

a motor powered winch having an elongated line rolled thereon, the line having an outer end;

an adaptor plate mount, separable from the winch, for fixing the motor powered winch to one location; and a carpet edge clamp with double operable jaws having gripping teeth for locking about the raised edge of a carpet.

12. The automated carpet removing device of claim 11, wherein the double jawed carpet edge clamp includes:

two handles for separately operating each of the double jaws.

13. The automated carpet removing device of claim 12, wherein the double jawed carpet edge clamp includes:

a pair of pivotable upper jaws; and a single base having raised teeth on an upper surface.

14. The automated carpet removing device of claim 13, wherein the upper jaws includes: downwardly protruding channels extending below the upper jaws.

15. An automated carpet removing device, comprising:

a motor powered winch having an elongated line rolled thereon, the line having an outer end;

a carpet gripper attached to the outer end of the line adapted for gripping a raised edge of a carpet; and an expandable anchor member having opposite facing clamp ends; and an adaptor plate for mounting the winch on a portion of the carpet spaced apart from the carpet grabber; the adaptor plate including a lower surface with gripping teeth and an upper surface having two C-shaped hooks, wherein the opposite facing clamp ends lock into the C-shaped hooks on the upper surface of the adaptor plate.

* * * * *